US006918439B2

(12) United States Patent
Dallas

(10) Patent No.: US 6,918,439 B2
(45) Date of Patent: Jul. 19, 2005

(54) BACKPRESSURE ADAPTOR PIN AND METHODS OF USE

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 32 days.

(21) Appl. No.: 10/336,911

(22) Filed: Jan. 6, 2003

(65) Prior Publication Data

US 2004/0129429 A1 Jul. 8, 2004

(51) Int. Cl.[7] ..... E21B 19/00

(52) U.S. Cl. ..... 166/85.3; 166/75.14; 166/97.1; 166/242.1; 166/192; 166/332.5

(58) Field of Search ..... 166/192, 70, 77.4, 166/85.3, 95.1, 97.1, 75.14, 332.5, 242.6, 242.1

(56) References Cited

U.S. PATENT DOCUMENTS

| | | | | | |
|---|---|---|---|---|---|
| 2,233,077 | A | * | 2/1941 | Gillespie et al. | 166/67 |
| 2,830,666 | A | * | 4/1958 | Rhodes | 166/97.1 |
| 2,939,534 | A | * | 6/1960 | Allen | 166/97.1 |
| 4,825,945 | A | * | 5/1989 | Smith | 166/87.1 |
| 4,923,006 | A | * | 5/1990 | Hartmann et al. | 166/65.1 |
| 5,012,865 | A | | 5/1991 | McLeod | 166/90 |
| 5,020,590 | A | * | 6/1991 | McLeod | 166/77.4 |
| 5,515,925 | A | | 5/1996 | Boychuk | 166/379 |
| 5,785,121 | A | | 7/1998 | Dallas | 166/90.1 |
| 5,819,851 | A | | 10/1998 | Dallas | 166/308 |
| 5,988,273 | A | * | 11/1999 | Monjure et al. | 166/75.14 |
| 5,988,274 | A | | 11/1999 | Funk | 166/77.4 |
| 6,012,519 | A | * | 1/2000 | Allen et al. | 166/75.14 |
| 6,145,596 | A | | 11/2000 | Dallas | 166/379 |
| 6,209,633 | B1 | | 4/2001 | Haynes | 166/72 |
| 6,220,363 | B1 | | 4/2001 | Dallas | 166/382 |
| 6,234,253 | B1 | | 5/2001 | Dallas | 166/377 |
| 6,289,993 | B1 | | 9/2001 | Dallas | 166/386 |
| 6,364,024 | B1 | | 4/2002 | Dallas | 166/379 |
| 6,510,900 | B2 | | 1/2003 | Dallas | 166/384 |
| 6,595,297 | B2 | | 7/2003 | Dallas | 166/382 |
| 6,695,064 | B2 | | 2/2004 | Dallas | 166/382 |

FOREIGN PATENT DOCUMENTS

| | | | |
|---|---|---|---|
| CA | 1285864 | 7/1991 | 166/52 |
| CA | 1290684 | 10/1991 | 166/59 |

OTHER PUBLICATIONS

U.S. Appl. No. 10/034,032 entitled "Slip Spool and Method of Using Same," filed Dec. 19, 2001.

U.S. Appl. No. 10/327,268 entitled "Slip Spool and Method of Using Same," filed Dec. 20, 2002.

U.S. Appl. No. 10/050,024 entitled "Well Stimulation Tool and Method of Using Same," filed Jan. 15, 2002.

* cited by examiner

*Primary Examiner*—Hoang Dang
(74) *Attorney, Agent, or Firm*—Nelson Mullins Riley & Scarborough, LLP

(57) ABSTRACT

A tubing assembly including a tubing string and tubing hanger provides a fluid passage with backpressure threads for securing a backpressure plug in a fluid-tight seal below the tubing hanger, so that the tubing hanger can be removed from the tubing string. The back pressure threads are preferably incorporated in a backpressure adapter pin connected between the tubing string and the tubing hanger. The adapter pin may also incorporate external weight-bearing shoulders for snubbing and/or suspending the tubing assembly. The backpressure plug is inserted or removed using a backpressure plug tool that slides through a packing in a pressurized casement that maintains pressure in an axial passage through a control stack of the wellhead.

6 Claims, 6 Drawing Sheets

BACKPRESSURE ADAPTOR PIN AND METHODS OF USE

CROSS-REFERENCE TO RELATED APPLICATIONS

This is the first application filed for the present invention.

MICROFICHE APPENDIX

Not Applicable.

TECHNICAL FIELD

The invention relates to the field of oil and gas well operations, and more particularly to a backpressure adapter pin and method of using the adapter pin to facilitate servicing operations for oil and gas wells.

BACKGROUND OF THE INVENTION

Modern methods for stimulating hydrocarbon flow in oil and gas wells has increased demand for well servicing knowledge and equipment. Common well servicing operations include removing and installing spools, valves, blowout preventors and other elements in a control stack on the wellhead, inserting downhole tools into the well, and/or injecting high-pressure well stimulation fluids. Modern equipment permits many of these operations to be performed without killing the well. This is advantageous because killing fluids are expensive and have the potential to reverse the beneficial effects of a well stimulation procedure.

The Applicant has invented many methods and tools for protecting wellhead components from pressurized fracturing fluid, to permit the fluid to be pumped into hydrocarbon wells, as described, for example, in co-pending United States patent application U.S. Pat. No. 6,364,024, entitled BLOWOUT PREVENTOR PROTECTOR AND METHOD OF USING SAME, which issued on Jan. 28, 2000. The fracturing fluids may be strongly acidic, or alkaline fluids and may be loaded with an abrasive proppant such as bauxite or sharp sand. Applicant's blowout preventor protectors have several advantages over the prior art, particularly because they permit a tubing string to be run into or out of the well, and accessed during the stimulation treatment. In order to insert the blowout preventor protector into the wellbore, the tubing hanger must be removed. Before the tubing hanger can be removed, the tubing string must be plugged to prevent an escape of hydrocarbons to atmosphere. This is preformed by setting a plug in the tubing string using a wireline lubricator, for example. This is an expensive and time consuming procedure that requires the use of wireline equipment to set the plug, as well as to remove it. As can be appreciated by those skilled in the art, if the tubing string is to be used during the stimulation process, for example as a "dead string" used to monitor downhole pressure, or as an extra stimulation fluid conduit or "flow back" tubing, the wireline plug must be set and removed two times during the well stimulation process. A first time to remove the tubing hanger, and a second time to re-attach it to the tubing string.

As is known in the art, some tubing hangers have backpressure threads for receiving commercially available plugs to seal the tubing string. Thus, the tubing hanger serves as a common point for sealing both annular and circular spaces in the well, as is well known in the art. Consequently, it is possible to remove and install the control stack elements without having to plug the production tubing using a wireline plug. However, if the tubing hanger is removed, the plug is removed with it, leaving the tubing string open to atmosphere. Since many well servicing operations require that the tubing hanger be removed and/or set, it is generally necessary to call in wireline equipment with crew at least twice during each such well servicing procedure.

To reduce the costs associated with well servicing procedures, it is therefore desirable to provide a method and apparatus for permitting a tubing string to be plugged below a tubing hanger without the use of wireline equipment.

SUMMARY OF THE INVENTION

It is therefore an object of the invention to provide a method and apparatus for selectively plugging a production tubing below a tubing hanger in a live hydrocarbon well.

The invention therefore provides a backpressure adapter pin for use in well servicing operations. The backpressure adapter pin comprises a tubing joint having a top and a bottom end and an axial passage that extends between the top and bottom ends, the top and bottom ends being adapted to be connected between a tubing string and a tubing hanger, wherein an inner wall of the axial passage includes backpressure threads adapted to retain a backpressure plug that is removably secured in a fluid-tight seal by the backpressure threads of the adapter pin.

The backpressure adapter pin may be adapted to be sealingly connected to a top of a coil tubing string or a jointed tubing string, and may be inserted or removed using a backpressure plug tool.

An outer wall of the adapter pin may be contoured so that when the adapter pin is connected to the tubing string, the adapter pin provides a weight-bearing shoulder for supporting and/or snubbing the tubing string.

The invention further provides a tubing assembly comprising a tubing string, and tubing hanger, the tubing hanger supporting the tubing string in a control stack for an oil or gas well. The tubing assembly comprises a backpressure thread on an internal wall of the tubing assembly below the tubing hanger. The backpressure thread is adapted to secure a backpressure plug in a fluid-tight seal for sealing the tubing string when the tubing hanger is removed from the tubing string.

The tubing assembly may further comprise a contoured surface below the tubing hanger that is shaped to provide a weight-bearing shoulder for suspending and/or snubbing the tubing string.

The backpressure threads may be located on an inner wall of an adapter pin connected between the tubing hanger and the tubing string.

The invention further provides a method for removing a tubing hanger from a wellhead of a live well. The method comprises a first step of inserting a plug in a backpressure adapter pin installed between the tubing hanger and the tubing string to seal the tubing string. After the plug is inserted, a landing joint is connected to a top of the tubing hanger, and the tubing hanger and the tubing string are lifted from a tubing head spool of the wellhead by raising the landing joint. An annulus of the live well is then closed and the tubing string is supported below the tubing hanger. The landing joint and the tubing hanger are then removed from the tubing string.

The tubing string may be raised a predetermined distance to align the adapter pin with slip blocks for supporting the tubing string and the slip blocks are closed around the adapter pin to support the tubing string.

The invention further provides a method for inserting a backpressure plug into a tubing assembly connected to a tubing hanger from which the tubing assembly is suspended in a live well. The method comprises a first step of mounting a backpressure plug tool to a top of a control stack on the well. Fluid pressure is then balanced between the well and a space between the backpressure plug tool and a blocking point in the control stack beneath the backpressure plug tool. After the fluid pressure is balanced, a backpressure plug is lowered through the axial passage using the backpressure plug tool and screwed into a backpressure adapter pin to plug the tubing string.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

The invention provides a method and apparatus for permitting the setting of a backpressure plug below a tubing hanger within reach of a backpressure plug tool. The apparatus is preferably embodied in a backpressure adapter pin, which may be a tubing collar, for example. The apparatus may alternatively be otherwise integrated with the tubing string below the tubing hanger, so that the tubing hanger may be removed or landed without setting or retrieving a wireline plug. Methods are provided for setting the backpressure plug, and removing a tubing hanger without the use of a wireline tool.

Figure 1C:
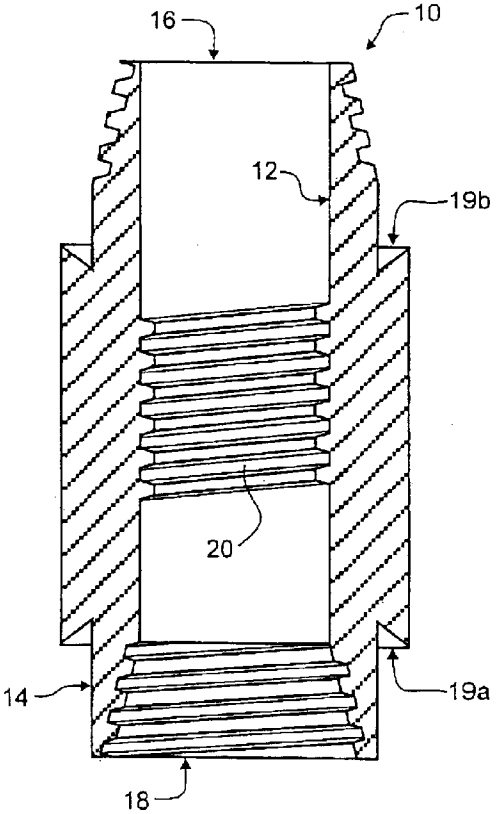
FIG. 1*c* is a schematic diagram of an adapter pin in accordance with the present invention, with a pin threaded top end, a box threaded bottom end, and shoulders for snubbing and supporting a tubing assembly.
Figure 1B:
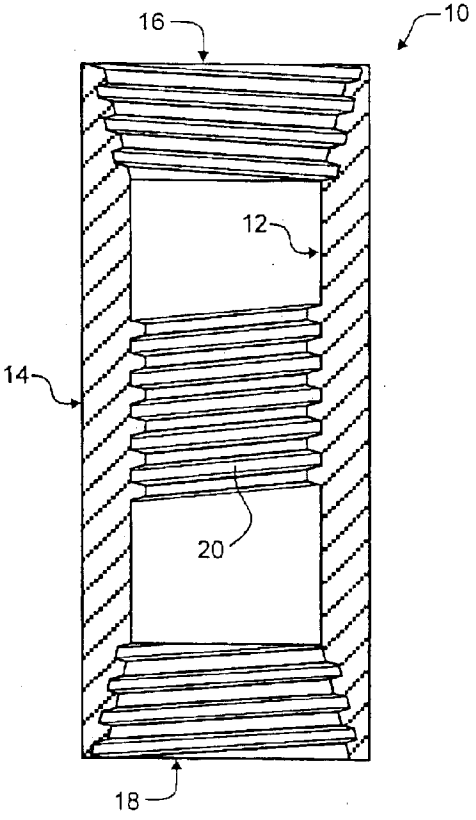
FIG. 1*b* is a schematic diagram of an adapter pin in accordance with the present invention, having box threaded top and bottom ends.
Figure 1A:
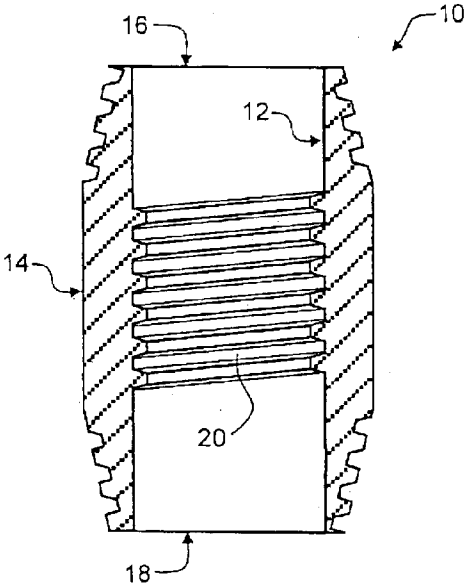
FIG. 1*a* is a schematic diagram of an adapter pin in accordance with the present invention, having pin threaded top and bottom ends.

As illustrated in FIGS. 1*a–e*, the backpressure adapter pin 10 is a tubing joint having substantially cylindrical inner 12 and outer 14 walls, a top end 16 and a bottom end 18. The top end 16 is adapted to be connected to a tubing hanger, or to a pup joint connected to the tubing hanger. The bottom end 18 is adapted to be connected to a tubing string. As illustrated in FIG. 1*a* the top end 16 and bottom end 18 are external upset end (EuE) threaded so that the adapter pin 10 can threadably connect to standard tubing hangers and standard tubing strings collars. The inner wall 12 of the adapter pin 10 has backpressure threads 20 commonly used in tubing hangers for receiving and retaining a backpressure plug (not illustrated) in a fluid-tight seal.

The adapter pin 10 illustrated in FIG. 1*a* is pin threaded EuE on both the top end 16 and bottom end 18, so that, for example, the adapter pin 10 (of FIG. 1*a*) can connect to a tubing hanger at the top end 16, and to a tubing collar at the bottom end 18.

The adapter pin 10 illustrated in FIG. 1*b* is box threaded EuE on both the top end 16 and bottom end 18, so that, for example, the adapter pin 10 (of FIG. 1*b*) can be connected to a pin threaded EuE pup joint at the top end 16 and to a joint of a tubing string at the bottom end 18. The adapter pin 10 shown in FIG. 1 can therefore be used as a tubing collar, the use and function of which are well known in the art.

The adapter pin 10 shown in FIG. 1*c* is pin threaded EuE on the top end 16, for coupling with a tubing hanger, for example, and box threaded EuE on the bottom end 18, for connection to a joint of a tubing string. The outer wall 14 of the adapter pin 10 illustrated in FIG. 1*c* includes two weight bearing circumferential shoulders. A shoulder 19*a* is adapted to mate with a slip block, and a shoulder 19*b* is adapted to mate with a snubbing block. The shoulder 19*a* is contoured to mate with the slip block of a slip spool, described in applicant's U.S. Pat. No. 6,695,064 which issued Feb. 24, 2004, entitled SLIP SPOOL AND METHOD OF USING SAME, the specification of which is incorporated herein by reference.

Figure 1E:
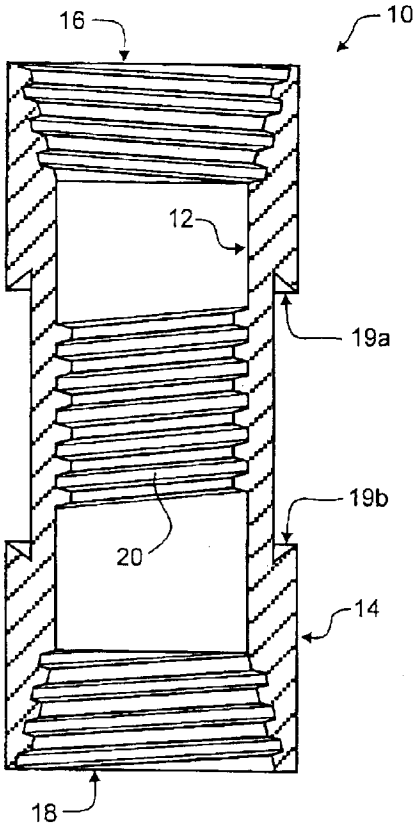
FIG. 1*e* is a schematic diagram of an adapter pin in accordance with the invention, having box threaded ends, and a recess defining shoulders for snubbing and supporting a tubing assembly.
Figure 1D:
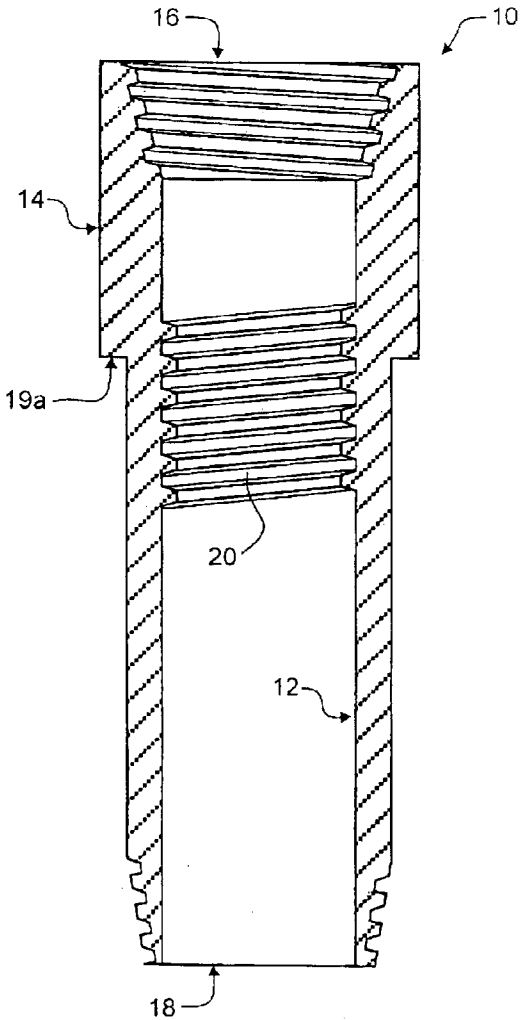
FIG. 1*d* is a schematic diagram of an adapter pin in accordance with the present invention, with a pin threaded bottom end, a box threaded top end, and a shoulder for supporting a tubing assembly.

The adapter pin 10 illustrated in FIG. 1*d* has box threaded EuE top end 16, and pin threaded EuE bottom end 18, permitting connection of a tubing collar to the bottom end 18, and a pup joint to the top end 16. The adapter pin 10 shown in FIG. 1*d* has a circumferential shoulder 19*a* which may be used to support a tubing string to which it is connected. The shoulder 19*a* shown in FIG. 1*d* is designed to be supported by substantially any slip block.

FIG. 1*e* illustrates an adapter pin 10 that is box threaded EuE on both the top end 16 and bottom end 18, and provides shoulders 19*a* for supporting and 19*b* for snubbing the tubing string. The shoulders 19*a,b* are respectively formed in a circumferential recess in the outer wall 14.

As will be understood by persons skilled in the art, although the adapter pin 10 shown in FIGS. 1*a–*1*e* is configured with EuE threads, other thread patterns or other types of connections can be used for the same purpose. As will be further understood, although the illustrated adapter pins 10 are straight-through adapters, the top end 16 and bottom end 18 may have different diameters, so that the adapter pin 10 also serves as a size adapter. As will be further understood, although the illustrated adapter pins 10 are configured for use with jointed tubing, they may be readily adapted to use with coil tubing using joints and connectors that are well known in the art.

Figure 2:
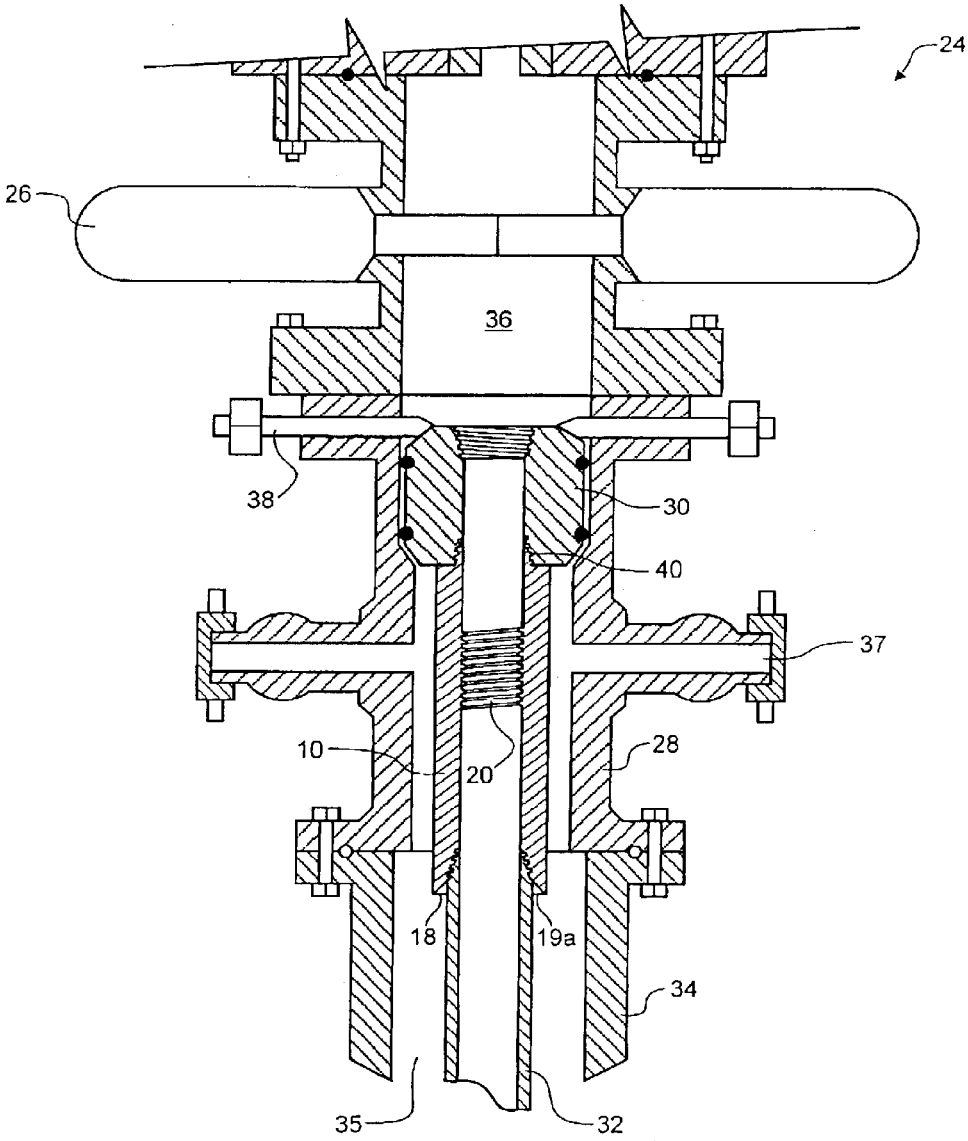
FIG. 2 is a schematic diagram of an adapter pin in accordance with the invention having a shoulder for supporting a tubing assembly, installed between a tubing hanger and tubing string supported by the tubing hanger.

FIG. 2 illustrates part of a wellhead control stack 24 that includes a blowout preventor (BOP) 26, and a tubing head spool 28. Inside the control stack 24 and the well below is a tubing assembly that includes a tubing hanger 30 landed in the tubing head spool 28, the adapter pin 10 connected to the tubing hanger 30 and to a tubing string 32. As is understood by those skilled in the art, the control stack 24 may include other elements than the BOP 26 and the tubing head spool 28. An axial passage 36 extends vertically through the control stack 22, providing access to the tubing string 32. The BOP 26 is illustrated in a closed condition, indicating that the axial passage is sealed. This is necessary in a live well to prevent hydrocarbons from escaping to atmosphere.

As is known in the art, many actions during well servicing operations on live wells require the shutting off of one or more of the axial passage 36, the tubing string 32, and an annular space (hereinafter refereed to as the annulus 35) between the interior of the tubing string 32, and an exterior wall of the tubing string 32. As is well known in the art, the BOP 26 normally includes a complement of blind rams adapted to seal the axial passage 36, and a complement of tubing rams adapted to provide a fluid seal around a tubing string. If there is no obstruction in the axial passage 36, the blind rams can be closed to seal the well bore. However, if the axial passage 36 is obstructed by the tubing string 32, tubing rams (of appropriate configuration) are used to block the flow through the annulus 35.

The tubing head spool 28 is mounted to the top of the well and secures the well casing 34 and supports the tubing hanger 30. The illustrated tubing head spool 28 further includes a pair of valves 37 used for known purposes outside of the scope of the present invention. The tubing hanger 30 seals against an inner wall of the tubing head spool 28, which includes at least two lock bolts 38 for locking the tubing hanger 30 against a seat of the tubing head spool 28. The tubing hanger 30 therefore seals the annulus 35 of the well.

A passage through the tubing hanger 30 includes threads for a rigid connection from above, for example, for connection of a landing joint (not illustrated). Further, while many tubing hangers known in the art have backpressure threads on an inner wall for threaded engagement of a backpressure plug, the tubing hanger 30 does not. In accordance with the present invention, the backpressure threads are removed to a lower point in the tubing assembly. In the illustrated embodiment, the backpressure threads 20 are provided on an inner wall 12 of the adapter pin 10.

The adapter pin 10 shown in FIG. 2 resembles the adapter pin 10 illustrated in FIG. 1*d*, insofar as it provides a shoulder 19*a* for supporting the tubing string 32, but does not provide a shoulder for snubbing the tubing string 32. It is different from the embodiment shown in FIG. 1*d* in that it provides the shoulder at the bottom end 18, rather than in the middle, and that the shoulder 19*a* of the adapter pin shown FIG. 1*d* is square, whereas the shoulder 19*a* of the adapter pin 10 shown in FIG. 2 is beveled.

As will be appreciated by those skilled in the art, the most convenient and economical time for installing the adapter pin 10 in a tubing string is during completion of the well, when the tubing string is being run into the well.

Figure 3:
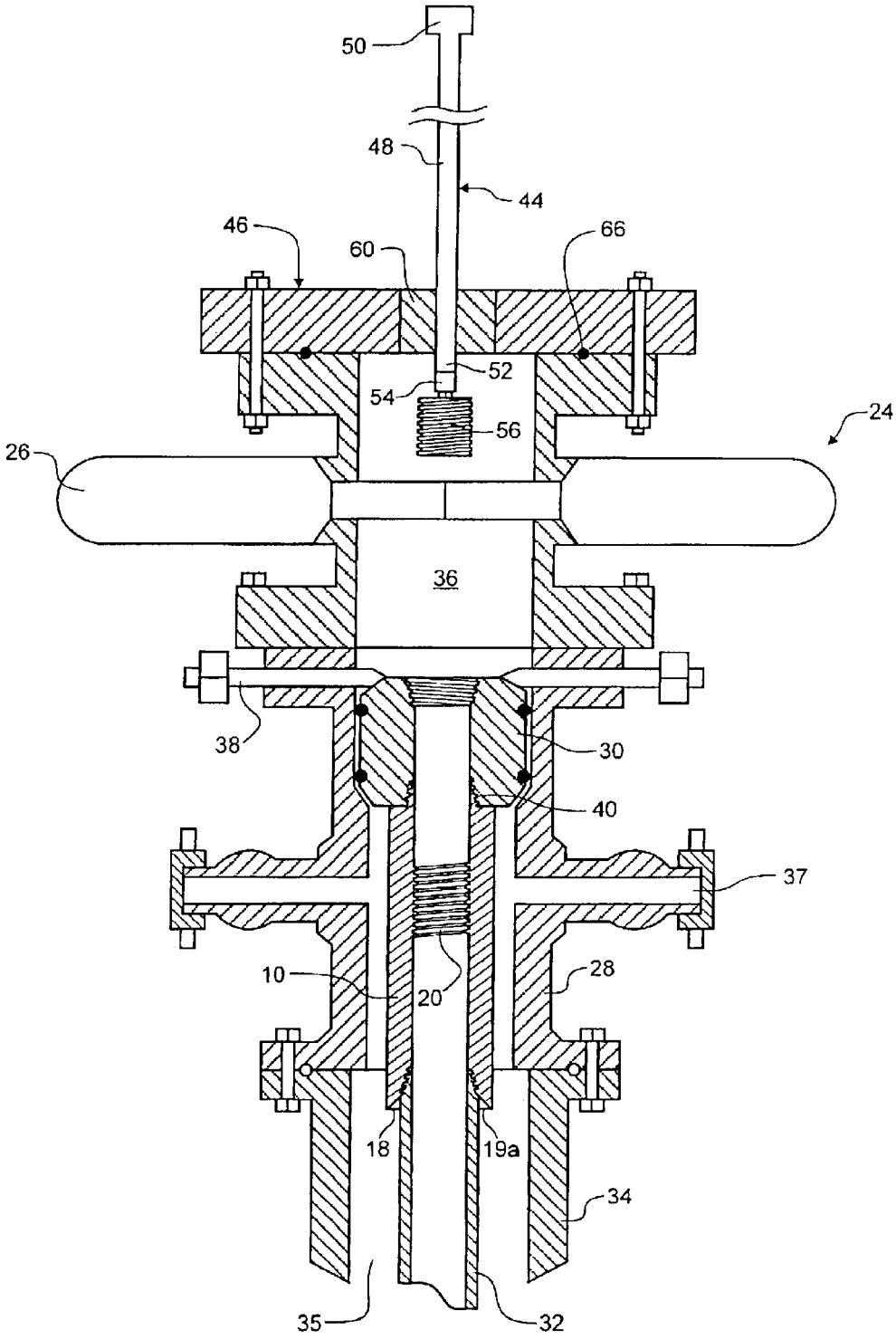
FIG. 3 is a schematic diagram of a backpressure plug tool for setting or retrieving a backpressure plug.

The well illustrated in FIG. 2 is a live well, a pressure difference between the hydrocarbon reservoir and atmosphere propels well fluids upwards, and the fluids are blocked in the annulus 35 by the tubing hanger 30, but can flow through the tubing string 32 into the axial passage as far as the blind rams of the BOP 26. In order to service the wellhead, or perform other well serving procedures, it is desirable to block the tubing string below the tubing hanger 30. This is performed by installing a backpressure plug tool 44 that includes a pressure containment flange 46, schematically illustrated in FIG. 3.

The backpressure plug tool 44 includes a backpressure plug installation rod 48 having a top end 50 that permits manipulation of a backpressure plug 56, when a bottom end 52 of the backpressure plug tool 44 is inserted into the axial passage 36 of the control stack 24. The bottom end 52 is adapted for coupling with an adapter head 54. The adapter head 54 engages the backpressure plug 56. The rod 48 extends through a packing 60 that permits the rod 48 to be moved rotationally and vertically, even if the axial passage 36 is under pressure. The outer diameter of the bottom end 52 of the rod 48 may be larger than that of the rod 48, so that the tool cannot be ejected from the pressure containment flange 46.

A method for inserting the backpressure plug 56 into the tubing assembly therefore includes steps of mounting the backpressure plug tool 44 with the pressure containment flange 46 to the top of the BOP 26. At this point, the axial passage 36 above the blind rams of the BOP 26 is at atmospheric pressure. As is well understood by those skilled in the art, the pressure containment flange 46 generally includes a pressure test port (not shown) used for pressure balancing and pressure release. Consequently, after the backpressure plug tool is installed on the BOP 26, the well pressure is balanced across the blind rams of the BOP 26 using a pressure bleed hose (not shown) connected between the tubing head spool 28 and the backpressure containment flange 46, in a manner well known in the art.

The blind rams of the blowout preventor 26 are then opened, the rod 48 is lowered, moving the backpressure plug 56 down through the pressurized axial passage 36 and to the tubing hanger 30. Once the backpressure plug 56 is in position above the backpressure threads 20 of the adapter pin 10, the backpressure plug tool 44 is used to rotate the backpressure plug 56 until it is sealingly secured in the backpressure threads 20. This may involve using a wrench at the top end 50 of the rod 48, in a manner known in the art.

After the backpressure plug 56 is set, the axial passage 36 remains under pressure, but isolated from the well pressures below the plug, as the well fluids are blocked from rising up through the tubing string 32. The pressure above the backpressure plug 56 is then bled off and the backpressure plug tool is removed. The blowout preventor 26 may also be removed, as the tubing hanger 30 blocks the annulus 35, and the backpressure plug 56 blocks the tubing string 32, below the BOP 26.

Removing the backpressure plug 56 from the adapter pin 10 is performed by reversing the steps described above. The BOP 26 (if not already installed on the control stack) is installed and the blind rams are closed. The pressure containment flange 46 with the backpressure plug tool 44 are installed and the pressure is balanced above the backpressure plug, as described above. The backpressure plug tool 44 is then used to remove the backpressure plug 56. The backpressure plug tool 44 is then pulled up to a position above the blind rams of the BOP 26. The blind rams are closed, sealing the axial passage 36. The pressure is then bled off above the blind rams of the BOP 26, and the backpressure containment flange 46 with the backpressure plug tool 44 are removed.

There are a number of well servicing procedures that are facilitated by separating the point at which the annulus 35 is blocked from the point where the tubing string 32 is sealed. It is well known in the art that the tubing hanger 30 must be set in the tubing head spool 28 in order to suspend the tubing string 32 in the well after the tubing string 32 has been run into the well during well completion, as described in Applicant's U.S. Pat. No. 6,595,297 entitled METHOD AND APPARATUS FOR INSERTING A TUBING HANGER INTO A LIVE WELL, which issued on Jul. 22, 2003, the specification of which is incorporated herein by reference. It is also well known that the tubing hanger 30 must be removed from the tubing head spool 28 when a mandrel of a blowout preventor protector is to be inserted through the wellhead, as explained for example, in the applicant's above-referenced U.S. Pat. No. 6,364,024. Generally, these procedures involve removing the tubing hanger 30 from the tubing head spool 28, and disconnecting the tubing hanger 30 from the tubing string 32. Accordingly, the invention provides a method for removing the tubing hanger 30 from a live well, without having to plug the production tubing using a wireline tool.

Figure 4:
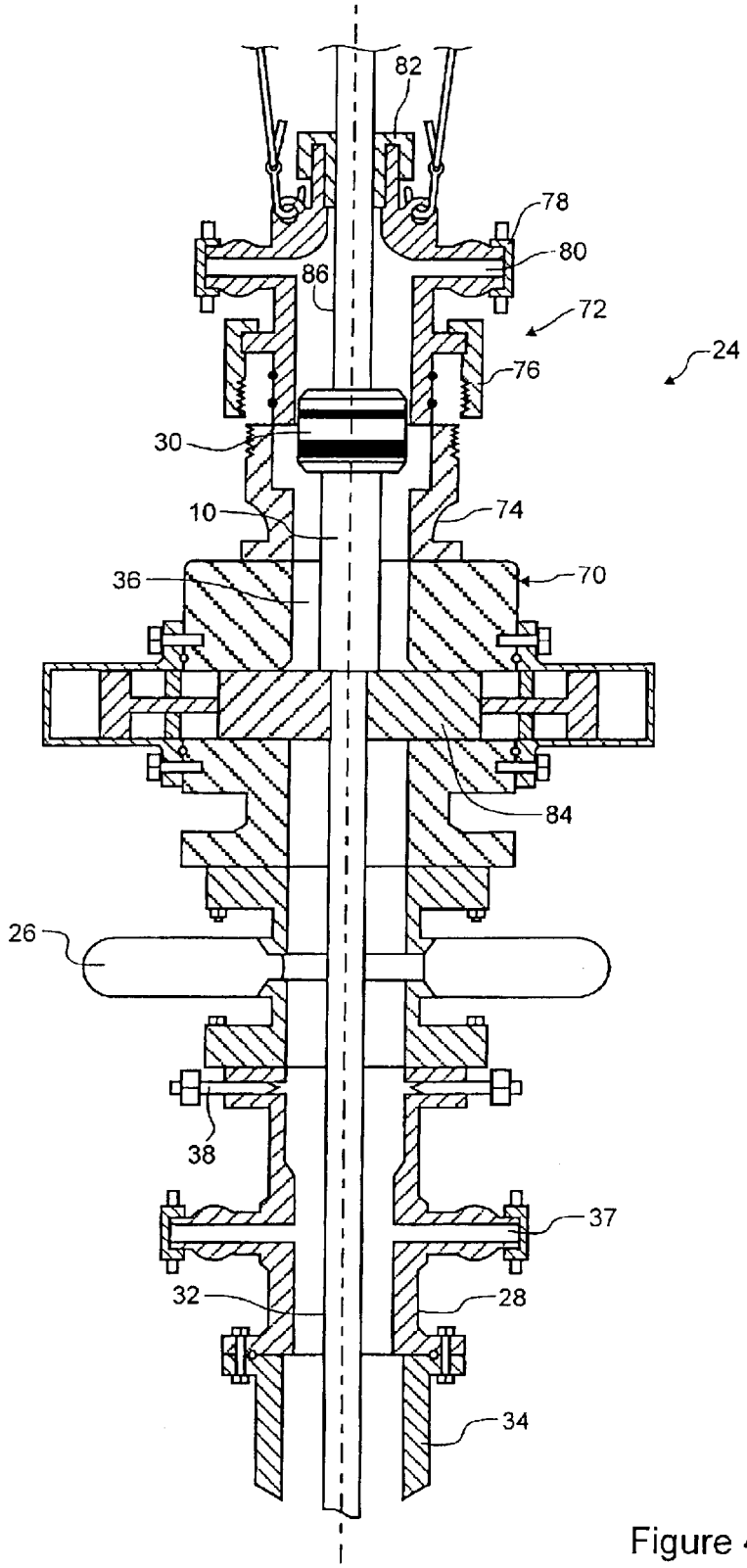
FIG. 4 schematically illustrates principal components for removing or landing a tubing hanger using the backpressure pin adapter in accordance with the present invention.

FIG. 4 schematically illustrates a control stack 24 that includes the tubing head spool 28, the BOP 26, and a slip spool 70, described in Applicant's U.S. Pat. No. 6,695,064. As described in that patent, the control stack 24 includes an annular adapter 72. The annular adapter 72 is connected to a top of the control stack 24. A Bowen union 74 is mounted to a top of the slip spool 70 and the annular adapter 72 is connected to the Bowen union 74 by a lockdown nut 76. The annular adapter 72 includes bleed-off valves 78 that control flow through radial passages 80. A landing joint 86 can be reciprocated through packing 82 that inhibits an escape of pressurized well fluids to atmosphere.

The slip spool 70 includes a set of slip blocks 84 that are controlled by hydraulic cylinders, as explained in detail in Applicant's U.S. Pat. No. 6,695,062. A top edge of each of the slip blocks is contoured to complement the beveled shoulder 19*a* of the adapter pin 10 illustrated in FIGS. 2, 3 & 4.

A tubing assembly shown in FIG. 4 includes the tubing hanger 30, the adapter pin 10, and tubing string 32, all of which have been described above. The tubing assembly is illustrated in side elevational view, so the backpressure plug 56, and backpressure threads 20 are not visible. The landing joint 86 is connected to a top end of the tubing hanger 30.

Accordingly the method of removing the tubing hanger 30 after the backpressure plug 56 is set in the adapter pin 10, involves first installing the slip spool 70 and annular adapter 72 onto the top of the control stack 24, above the BOP 26. Once these spools are sealed and pressure balanced, the landing joint 86 is lowered down through the axial passage 36, and into the tubing hanger 30 where it is rotated to engage box threads in a top of the tubing hanger 30.

The lock bolts 38 are retracted and the landing joint 86 is then hoisted to raise the tubing assembly up through the control stack 24. Hoisting the landing joint 86 unseats the tubing hanger 30. Once the tubing hanger 30 and adapter pin 10 have been pulled up far enough to clear the tubing rams of the BOP 26, the tubing rams may be closed around the tubing string 32, blocking the fluid path between the axial passage above the BOP 26 and the reservoir below. After the tubing rams are closed, the bleed-off valve 78 is opened to release the pressurized fluid contained in the axial passage 36 above the tubing rams of the BOP 26. After the adapter pin 10 is raised above a top of the slip blocks 84, the slip blocks 84 are extended, and the landing joint 86 is lowered so that a weight of the tubing string is supported by the slip blocks 84.

Once the pressure in the axial passage 36 above the tubing rams is released, the annular adapter 72 is removed by disconnecting the landing joint 86 and unscrewing the lockdown nut 76. The tubing hanger 30 is therefore exposed, and can be removed. If desired, the Bowen Union 74 may also be removed.

Steps involved in inserting the tubing hanger 30 into the tubing head spool 28 are substantially the reverse of the method of removing the tubing hanger 30, and will not be repeated here.

Those skilled in the art will understand that the slip spool 70 is not essential to the procedure described above, and other slip devices can be used to temporarily support the tubing string. For example, after the lockdown nut 76 is released, the adapter spool 72 and the landing joint may be raised further so that the adapter pin 10 is higher than the control stack, at which point it can be supported by a conventional slip block, for example.

Figure 5:
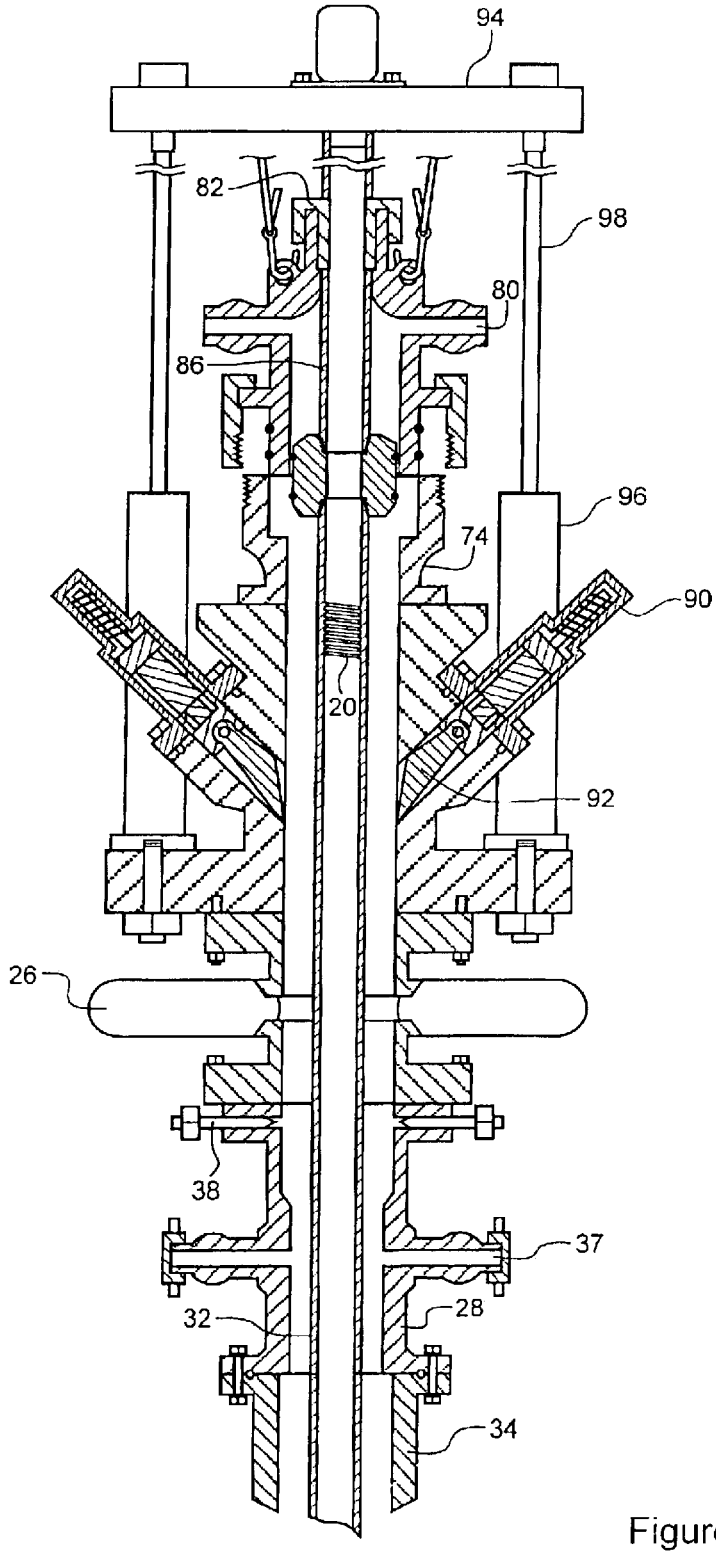
FIG. 5 schematically illustrates alternative components for removing or landing the tubing hanger using the backpressure pin adapter in accordance with the present invention.

FIG. 5 schematically illustrates a control stack that is different form the one described above with reference to FIG. 4. The slip spool 70 is replaced with a hydraulic slip spool 90 that supports the tubing string 32 using slip jaws 92, as described in Applicant's Published U.S. patent application Ser. No. 20030116326 published on Jun. 26, 2003, the specification of which is incorporated herein by reference. The slip jaws 92 are shown in a retracted position. A base plate of the hydraulic slip spool 90 is provisioned with a hydraulic system 94. The hydraulic system 94 includes two or more hydraulic cylinder 96 operatively coupled to respective piston rods 98. The details and operation of such a hydraulic system is well known in the art and not described here. In this embodiment, the backpressure threads 20 for receiving the backpressure plug 56 are incorporated in a tubing joint of the tubing string 32.

The invention therefore permits a tubing string to be plugged and a tubing hanger to be removed from a live well without the use of wireline equipment. The method and apparatus in accordance with the invention permit the backpressure plug to be set or removed more quickly than can be accomplished using a wireline lubrication, and at much less expense. Consequently, the invention permits many well completion and servicing operations to be performed more quickly at a reduced cost.

The embodiment(s) of the invention described above is(are) intended to be exemplary only. The scope of the invention is therefore intended to be limited solely by the scope of the appended claims.

I claim:

1. A tubing assembly, comprising:

a tubing string and a tubing hanger, the tubing hanger supporting the tubing string in a control stack above an oil or gas well; and a backpressure thread on an internal wall of the tubing assembly below the tubing hanger, the backpressure thread removably securing a backpressure plug in a fluid-tight seal to seal the tubing string.

2. A tubing assembly as claimed in claim 1 further comprising a contoured surface below the tubing hanger that is shaped to provide a weight-bearing shoulder for supporting the tubing string.

3. A tubing assembly as claimed in claim 1 further comprising a contoured surface below the tubing hanger that is shaped to provide a weight-bearing shoulder for snubbing the tubing string.

4. A tubing assembly as claimed in claim 1 wherein the backpressure thread is located on an inner wall of an adapter pin connected between the tubing hanger and the tubing string.

5. A tubing assembly as claimed in claim 4 wherein the adapter pin comprises a contoured surface that is shaped to provide a weight-bearing shoulder for supporting and a weight-bearing shoulder for snubbing the tubing string.

6. A tubing assembly as claimed in claim 5 wherein the contoured surface is rotationally symmetric so that the contoured surface provides the weight-bearing shoulders independently of a rotational position of the adapter pin.

* * * * *